US007666038B2

(12) United States Patent
Yomo et al.

(10) Patent No.: US 7,666,038 B2
(45) Date of Patent: Feb. 23, 2010

(54) STEERING ARM STRUCTURE OF OUTBOARD MOTOR

(75) Inventors: Shigeki Yomo, Iwata (JP); Yoshihiro Horitani, Hamamatsu (JP)

(73) Assignee: Suzuki Kabushiki Kaisha, Hamamatsu-shi (JP)

( * ) Notice: Subject to any disclaimer, the term of this patent is extended or adjusted under 35 U.S.C. 154(b) by 35 days.

(21) Appl. No.: 12/044,425

(22) Filed: Mar. 7, 2008

(65) Prior Publication Data

US 2008/0268729 A1 Oct. 30, 2008

(30) Foreign Application Priority Data

Mar. 9, 2007 (JP) ..... 2007-059508

(51) Int. Cl.
*B63H 20/08* (2006.01)

(52) U.S. Cl. ..... 440/53; 440/84; 440/86; 440/87

(58) Field of Classification Search ..... 440/52, 440/53, 58, 60, 63, 84, 87, 86; 74/480 B; 200/61.54
See application file for complete search history.

(56) References Cited

U.S. PATENT DOCUMENTS

| | | | | | |
|---|---|---|---|---|---|
| 4,241,687 | A * | 12/1980 | DuBois et al. | ..... | 440/63 |
| 4,650,429 | A * | 3/1987 | Boda | ..... | 440/87 |
| 5,378,178 | A * | 1/1995 | Haman | ..... | 440/53 |
| 5,421,755 | A * | 6/1995 | Kakizaki | ..... | 440/63 |
| 5,797,777 | A * | 8/1998 | Tsunekawa et al. | ..... | 440/84 |
| 6,093,066 | A * | 7/2000 | Isogawa et al. | ..... | 440/63 |
| 6,592,414 | B2 * | 7/2003 | Mineno et al. | ..... | 440/53 |

FOREIGN PATENT DOCUMENTS

| | | |
|---|---|---|
| JP | 2718149 | 9/1990 |
| JP | 3470547 B | 9/1998 |
| JP | 2002-70594 | 3/2002 |

* cited by examiner

*Primary Examiner*—Lars A Olson
(74) *Attorney, Agent, or Firm*—Barnes & Thornburg LLP

(57) ABSTRACT

An outboard motor is steerably mounted to a hull via a bracket and a steering arm is mounted to a steering bracket unit attached to the outboard motor. The steering arm includes a shift grip as a shift operating unit, a throttle grip as a throttle operating unit and a throttle adjusting knob as a throttle adjusting operating unit. These units are adjacently disposed in the described order in a forward direction of a hull.

5 Claims, 7 Drawing Sheets

STEERING ARM STRUCTURE OF OUTBOARD MOTOR

CROSS-REFERENCE TO RELATED APPLICATIONS

This application is a U.S. Application based upon and claiming the benefit of priority to Japanese Application No. 2007-059508, filed on Mar. 9, 2007, the contents of which are incorporated herein by reference.

BACKGROUND OF THE INVENTION

1. Field of the Invention

The present invention relates to a steering arm structure of an outboard motor.

2. Related Art

An outboard motor is typically mounted to a hull via a swivel bracket and a clamp bracket. The swivel bracket is fixed to the outboard motor and the clamp bracket is fixed to the hull. The swivel bracket is rotatably pivoted to the clamp bracket via a pilot shaft.

For example, a steering bracket is provided rotatably at the top end of the pilot shaft so as to rotate integrally with the pilot shaft, and a steering arm extending forward is mounted at the front end of the steering bracket. By swinging the steering arm to the right or left, the outboard motor can be steered to the right or left about the pilot shaft with respect to the bracket.

Generally, a throttle grip is provided at the front end of the steering arm so as to enable both throttle and steering operation to be performed at the same time. In recent years, a shift operating unit and switches are mounted to the operation handle so as to improve the operability (see, for example, Japanese Patent Nos. 3470547, 2718149, and Japanese Patent Application Laid-Open Publication No. 2002-70594).

However, although the steering arm described in Japanese Patent No. 3470547 is so constructed that throttle operation is performed in accordance with a rotation system (grip type system), shift operation is carried out by lever. Further, since the shift lever is provided in the center of the side surface of the steering arm, and an adjuster of the throttle is provided on an opposite side to the shift lever, it is difficult to say that the operability of each operating unit is good.

In the steering arm described in Japanese Patent No. 2718149, although the throttle operation and the shift operation are carried out by the rotation system and the operating unit is coaxially adjacently disposed, there is no disclosure about other components such as the throttle adjuster.

Furthermore, although in the steering arm described in Japanese Patent Application Laid-Open Publication No. 2002-70594, a throttle using the rotation operating system and a throttle opening holding unit are disposed coaxially adjacent to each other, the structure is complicated and many components or elements are disposed, and in addition, it will be difficult to obtain an excellent adjustability. Furthermore, there is no disclosure about other components such as the shift unit and steering adjuster.

SUMMARY OF THE INVENTION

The present invention has been achieved in consideration of the circumstances encountered in the prior art mentioned above, and an object of the present invention is to provide a steering arm structure of an outboard motor having a simple structure provided with plural functions and having an improved operability.

This and other objects can be achieved according to the present invention by providing a steering arm structure of an outboard motor steerably mounted to a hull via a bracket, in which a steering arm is mounted to a steering bracket unit attached to the outboard motor, the steering arm comprising: a shift operating unit; a throttle operating unit; and a throttle adjusting operating unit which are adjacently disposed in the described order along an advancing direction of a hull.

In a preferred embodiment of the above aspect, the shift operating unit, the throttle operating unit and the throttle adjusting operating unit may be disposed coaxially on a common rotation axis.

The steering arm may further include a steering adjusting operating unit disposed adjacently to the throttle adjusting operating unit.

The steering adjusting operating unit may be disposed coaxially on a common rotation axis of the throttle adjusting operating unit. The throttle adjusting operating unit may have a rotation axis is offset from a rotation axis of the throttle operating unit.

The shift operating unit may include a shift grip, the throttle operating unit includes a throttle grip, and the throttle adjusting operating unit includes a throttle adjusting knob, the shift grip, the throttle grip and the throttle adjusting knob being arranged to be rotatably. The steering arm structure may further include a steering adjusting operating unit including a steering adjusting knob disposed adjacent to the throttle adjusting knob to be rotatably.

According to the steering arm structure of the characters mentioned above, the respective operating units can be arranged in compact as well as improved operability can be obtained. The adjusting performance can be also achieved with simple structure.

The nature and further characteristic features of the present invention will be made clearer from the following descriptions made with reference to the accompanying drawings.

DESCRIPTION OF THE PREFERRED EMBODIMENTS

Hereinafter, the preferred embodiments of the present invention will be described with reference to the accompanying drawings. Further, it is to be noted that terms "right", "left", "upper", "lower" and the like terms are used herein with reference to the illustration on the drawings or an actually mounted state of an outboard motor.

Figure 1:
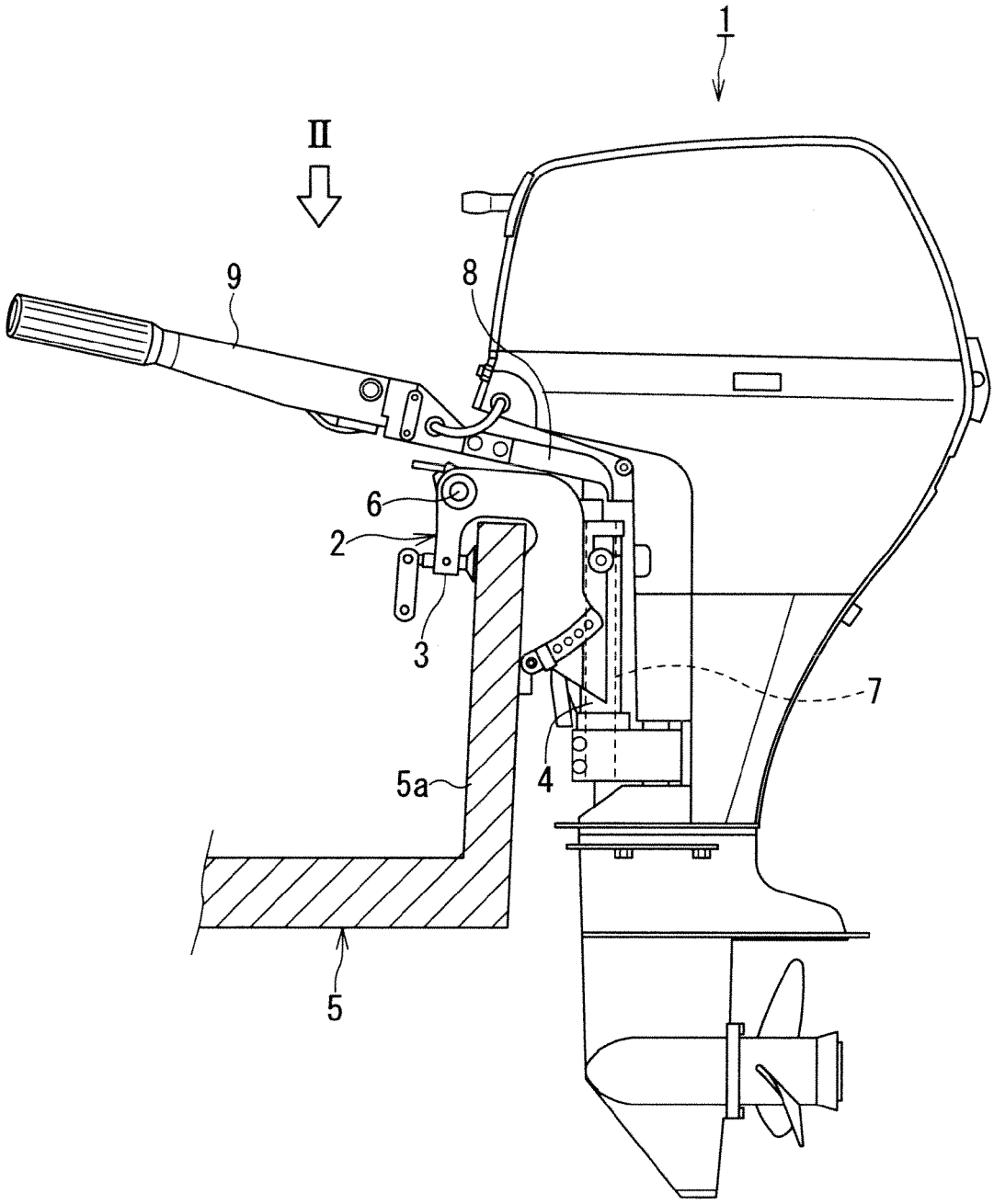
FIG. 1 is an illustrated left side view of an outboard motor provided with a steering arm structure according to an embodiment of the present invention.

FIG. 1 is a left side view showing an embodiment of an outboard motor to which the present invention is applicable. As shown in FIG. 1, the outboard motor 1 includes a bracket 2. The bracket 2 mainly includes a clamp bracket 3 fixed to a transom 5*a* of a hull 5 and a swivel bracket 4 fixed to the outboard motor 1.

The swivel bracket 4 is pivoted tiltably in a vertical direction via a tilt shaft 6 provided between a pair of the right and left clamp brackets 3, and a pilot shaft 7 is pivoted rotatably in a perpendicular direction within the swivel bracket 4. A steering bracket 8 is attached to the top end of the pilot shaft 7 so as to be integrally rotatable.

A steering arm 9 extending forward is mounted to the front end of the steering bracket 8. By swinging this steering arm 9 to the right or left, the outboard motor 1 can be operated to the right or left side about the pilot shaft 7 with respect to the bracket 2. Further, the outboard motor can be tilted and trimmed upward about the tilt shaft 6.

Figure 2:
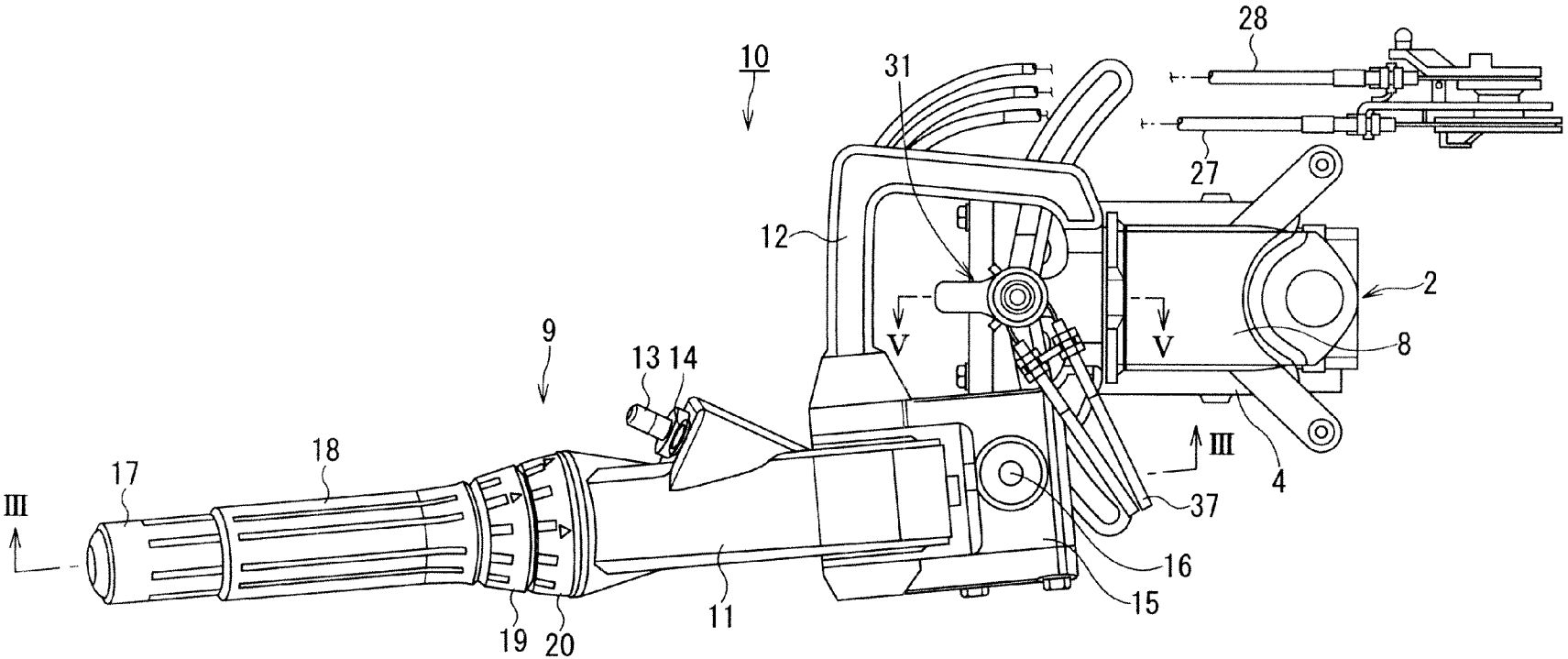
FIG. 2 is a view shown from a direction of an arrow II in FIG. I as a plan view showing a first embodiment of a steering arm unit including the steering arm and its peripheral components.

FIG. 2 is a view shown from a direction of an arrow II in FIG. 1 as a plan view of a steering arm unit 10 including the steering arm 9 and its peripheral components.

As shown in FIG. 2, the rear end portion of an arm housing 11 constituting the steering arm 9 is vertically swingably mounted to the front portion of the steering bracket 8 via the steering arm bracket 12. An engine stop switch 13 and an oil alarming lamp 14 are provided on the side surface of the steering arm housing 11, and an engine starter switch 16 is provided on the top surface of the steering arm cover 15 constituting a supporting member of the steering arm housing 11 of the steering arm bracket 12.

A shift grip 17, which is a shift operating unit, a throttle grip 18, which is a throttle operating unit, a throttle adjusting knob 19, which is a throttle adjustment operating unit, and a steering adjustment knob 20, which is a steering adjustment operating unit, are adjacently disposed in series at the front end portion of the steering arm housing 11 in the described order from the free end side in an advancing direction (left side in FIG. 2) in a manner such that the respective operating units 17 to 20 are disposed on the same rotating shaft 21.

Figure 3:
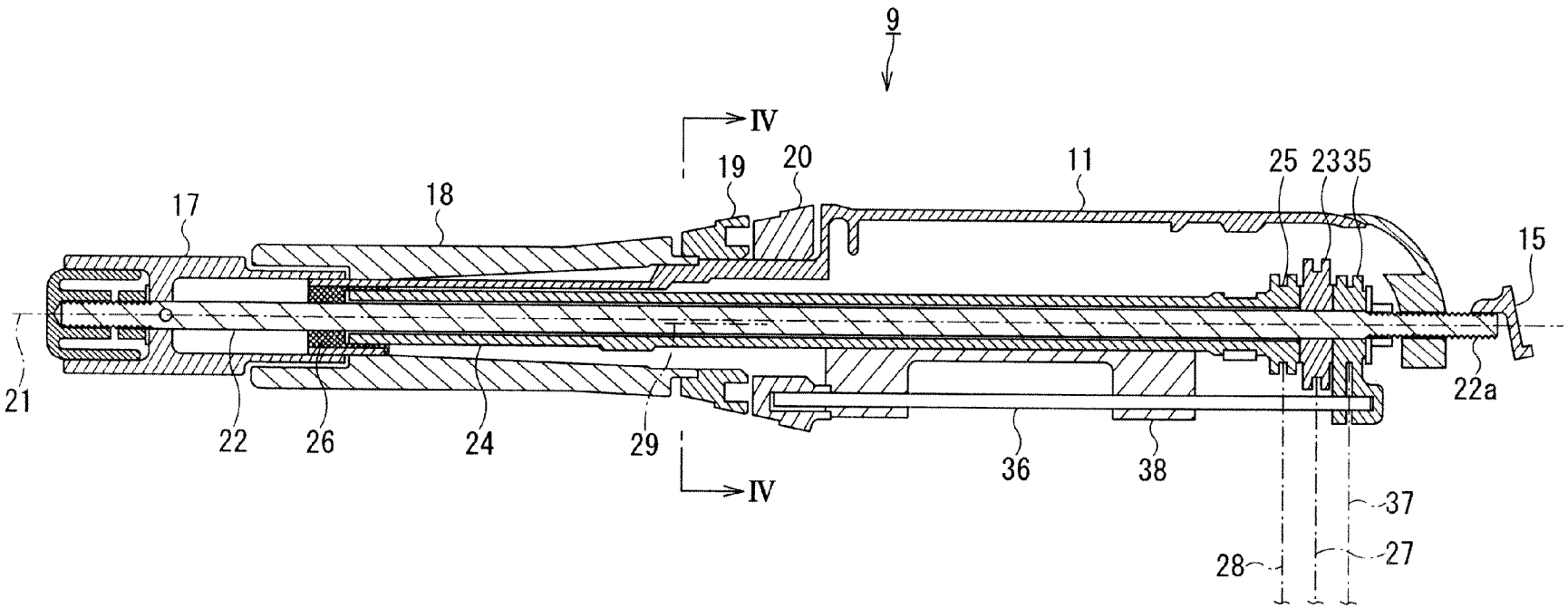
FIG. 3 is a sectional view taken along the line III-III in FIG. 2.
Figure 4:
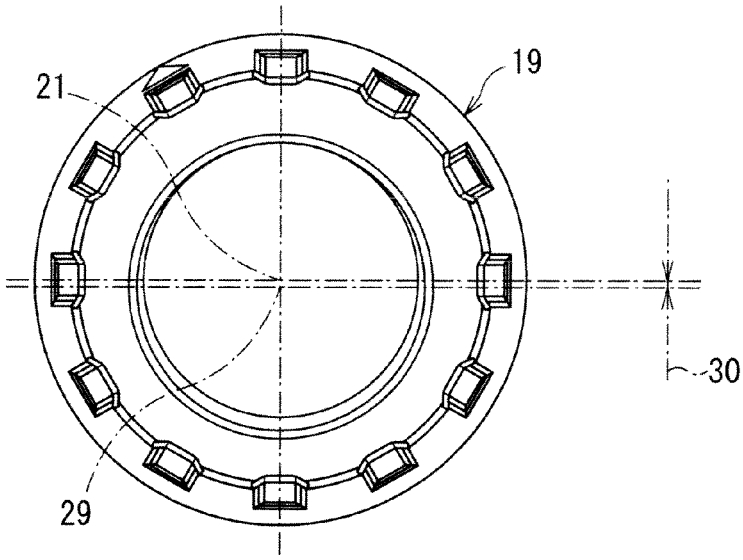
FIG. 4 is a sectional view taken along the line IV-IV in FIG. 3.

As shown in FIG. 3, a shift rod 22 is disposed on the rotating shaft 21 of the operation portion. The shift grip 17 is provided at the front end of the shift rod 22, and a shift drum 23 is provided at the rear portion of the shift rod 22 so that the shift grip 17 and the shift drum 23 are rotated integrally with the shift rod 22. A throttle rod 24 is disposed on the rotating shaft 21 of the operating unit. This throttle rod 24 is formed of a pipe member and the shift rod 22 is inserted therethrough. The throttle grip 18 is attached to the front end of the throttle rod 24, and a throttle drum 25 is attached to the rear end of the throttle rod 24 so that the throttle grip 18 and the throttle drum 25 are rotated integrally with the throttle rod 24.

The shift rod 22 and the throttle rod 24 are supported by the steering arm housing 11 via an odd-shaped bushing (anomalous outline bushing) 26 so that each axis is supported. The odd-shaped bushing 26 is structured to be non-rotatable with respect to the steering arm housing 11 so as to prevent the shift rod 22 and the throttle rod 24 from being rotated together. The rear end of the shift rod 22 is projected out of the steering arm housing 11 and a projecting end 22*a* of this shift rod 22 is engaged with the steering arm cover 15 when the steering arm 9 is normally used. Consequently, load applied to the steering arm 9 is received by the shift rod 22 having stiffness so as to reduce the stiffness of the steering arm 9.

Two shift cables 27 are connected to the shift drum 23 at their one ends and throttle cables 28 are also connected to the throttle drum at their one ends, while the other ends of the cables 27 and 28 are respectively connected to a shift unit and a throttle unit, not shown, provided in the hull 1 so as to transmit an operation of an operator thereto.

This steering arm 9 includes a throttle adjusting knob 19 for adjusting the rotation torque of the throttle grip 18. The throttle adjusting knob 19 is rotatably mounted to the steering arm housing 11 disposed backward of the throttle grip 18. The rear edge portion of the throttle grip 18 extends backward in a shape of a flange, and inner peripheral surface front side of the throttle adjusting knob 19 overlaps the outer peripheral surface of the rear edge portion of the throttle grip 18. Further, the rotating axis 29 of the throttle adjusting knob 19 is formed offset by a predetermined distance (an offset 30) from the rotating axis 21 of the throttle grip 18 (operating unit).

Consequently, when the throttle adjusting knob 19 is rotated, the inner peripheral surface of the throttle adjusting knob 19 and the outer peripheral surface of the rear edge portion of the throttle grip 18 make contact with each other due to the offset 30, so that the rotation torque of the throttle grip 18 can be adjusted by frictional force. The throttle grip 18 can be held at a predetermined operating degree.

Figure 5:
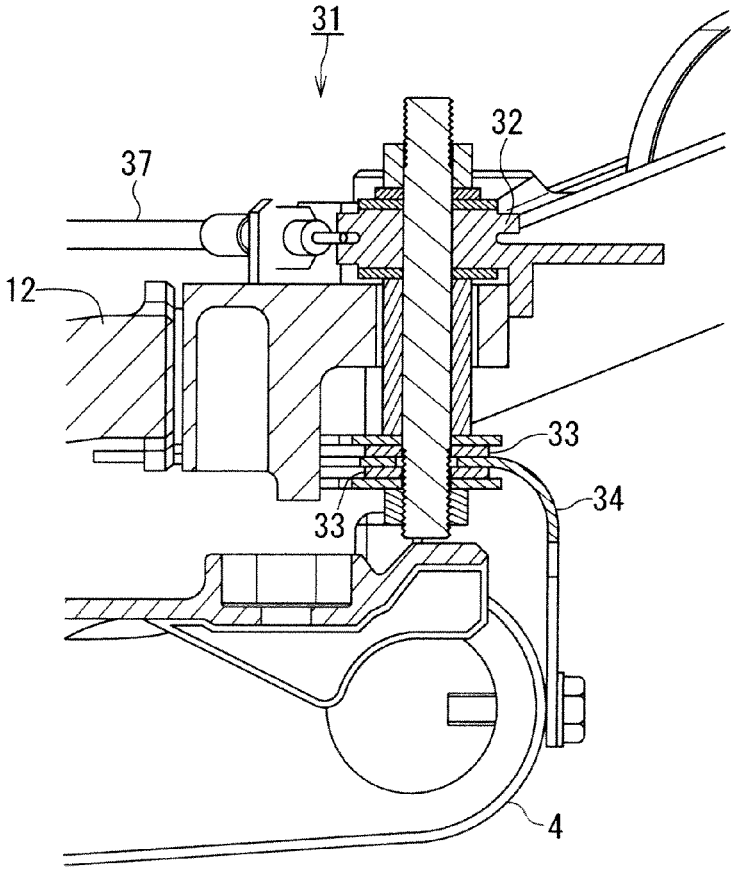
FIG. 5 is a sectional view taken along the line V-V in FIG. 2.

On the other hands a steering adjusting unit 31 capable of adjusting the steering load when the outboard motor 1 is steered is provided on the steering arm unit 10. As shown in FIG. 5, the steering adjusting unit 31 includes a steering adjusting lever drum 32 between the steering arm bracket 12 for supporting the steering arm housing 11 and the swivel bracket 4 located on the outboard motor side. By rotating the steering adjusting lever drum 32, a friction plate 33 provided on the steering arm housing side sandwiches the steering adjusting plate 34 provided on the swivel bracket side to thereby adjust the steering load or secure the steering of the outboard motor.

The steering adjusting lever drum 32 is rotated through remote control by the steering adjusting knob 20 provided on the steering arm housing 11. As shown in FIG. 3, the steering adjusting knob 20 is rotatably mounted to the steering arm housing 11 disposed on the rear side of the throttle adjusting knob 19. A steering adjusting drum 35 is rotatably provided at the rear end portion of the shift rod 22. The steering adjusting knob 20 and the steering adjusting drum 35 are connected by means of steering adjusting rod 36 as rotation transmitting means, and the two steering adjusting cables 37 are connected to the steering adjusting drum 35 at one ends thereof, while the other ends of these steering adjusting cables 37 are connected to the steering adjusting lever drum 32 so as to transmit an operated motion of the operator.

The steering adjusting rod 36 is disposed below the shift rod 22 and the throttle rod 24 and in parallel to these rods 22, 24, and the steering adjusting rod 36 is inserted into a guide member 38 supported by the throttle rod 24 so as to be prevented from being twisted. Further a rotation of the steering adjusting knob 20 can be reliably transmitted to the steering adjusting drum 35.

Instead of assembly of the steering adjusting rod 36 and the guide member 38 as the rotation transmitting means, it may be permissible to use a plate material having a length in the peripheral direction of the steering adjusting knob 20 so as to provide the rotation transmitting means with stiffness.

Figure 6:
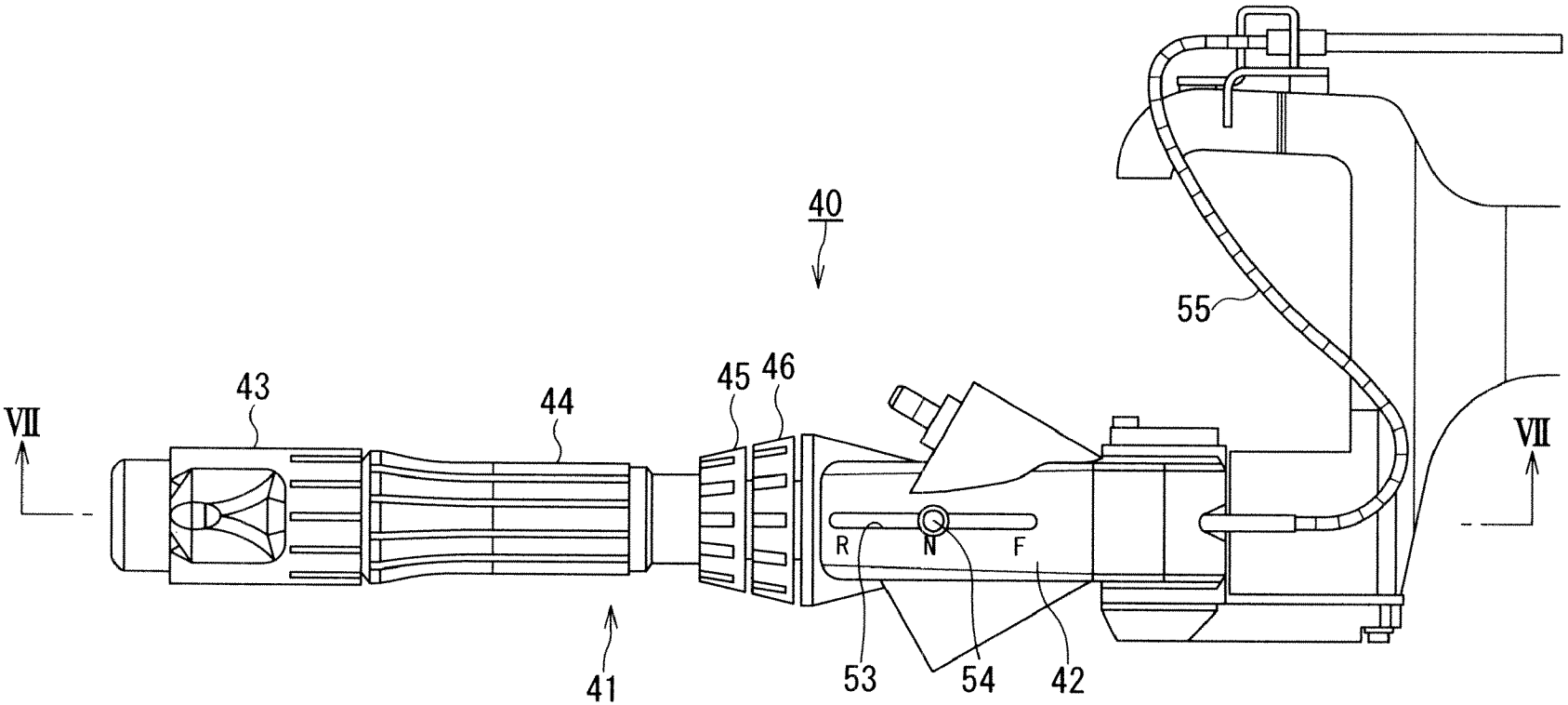
FIG. 6 is a plan view showing a steering arm unit according to a second embodiment of the present invention.
Figure 7:
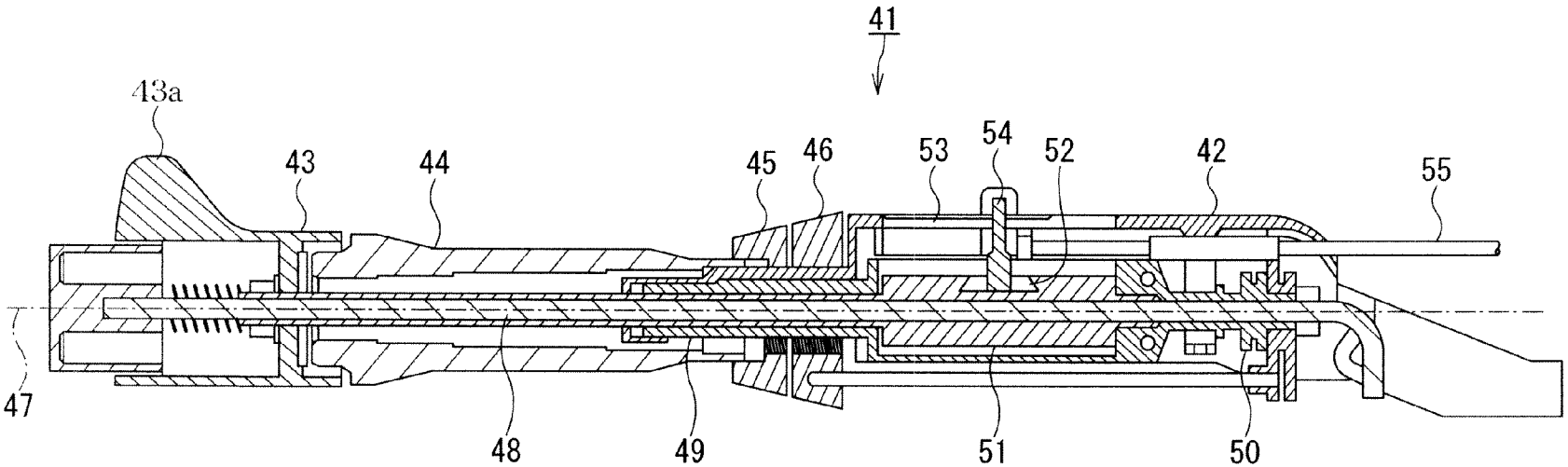
FIG. 7 is a sectional view taken along the line VII-VII of FIG. 6.

FIG. 6 is a plan view showing a second embodiment of a steering arm unit 40. FIG. 7 is a sectional view taken along the line VII-VII of FIG. 6 and FIG. 8 is an enlarged plan view of major portions of FIG. 6.

Although the steering arm unit 40 of the second embodiment basically has substantially the same structure as that of the steering arm unit 10 of the first embodiment, the steering arm unit 40 of the second embodiment adopts a shift operation transmitting mechanism using a single push-pull cable while the steering arm unit 10 of the first embodiment adopts the shift operation transmitting mechanism using two pull-pull cables.

Figure 8:
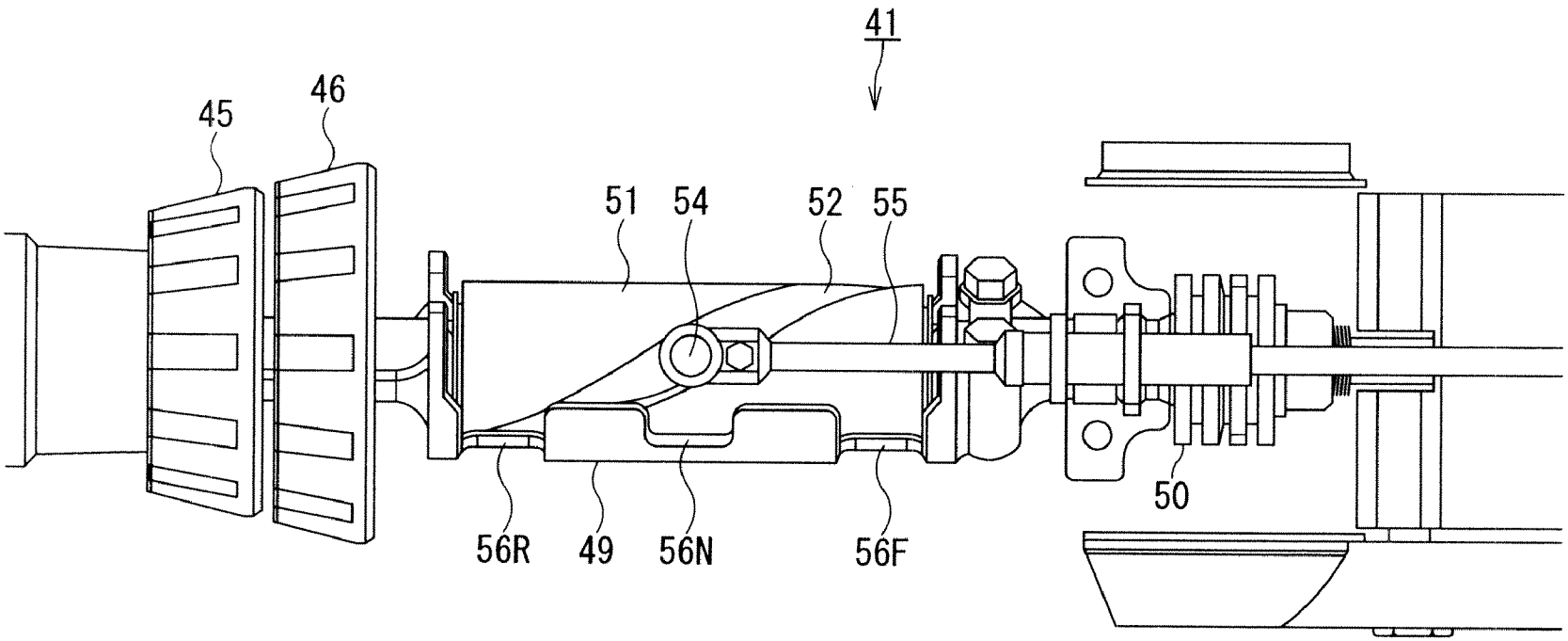
FIG. 8 is an enlarged plan view of major portions of FIG. 6.

As shown in FIG. 6 to FIG. 8, a shift grip 43, which is a shift operating unit, a throttle grip 44, which is a throttle operating unit, a throttle adjusting knob 45, which is a throttle adjusting operating unit and a steering adjusting knob 46, which is a steering adjusting operating unit, are adjacently disposed in the described order from the free end side in the advancing direction (i.e., left side in FIG. 6) at the front end portion of the steering arm housing 42 constituting a steering arm 41. The respective operating units 43 to 46 are disposed on the same rotating shaft 47 as a rotation-operation system.

A shift rod 48 is disposed on the rotating shaft 47 of the operating unit. A shift grip 43 is disposed at the front end of the shift rod 48 so as to rotate integrally with the shift rod 48. A throttle rod 49 is disposed on the rotating shaft 47 of the operating unit and is formed of a pipe member, through which the shift rod 48 is inserted. Then, the throttle grip 44 is provided rotatably at the front end of the throttle rod 49 and the throttle drum 50 is provided rotatably at the rear end of the throttle rod 49 so that the throttle grip 44 and the throttle drum 50 rotate integrally with the throttle rod 49.

A shift drum 51 is provided on the shift rod 48 in the steering arm housing 42 so as to rotate integrally with the shift rod 48 and a helical groove 52 is formed in the outer peripheral surface of this shift drum 51. On the other hand, a slit 53 extending in the back and forth direction is formed in the top surface of the steering arm housing 42, and a shift pin 54 is fitted slidably to both the slit 53 and the helical groove 52. One end of the shift cable 55 is connected to this shift pin 54, while the other end of this shift cable 55 is connected to a shift unit, not shown, provided in the outboard motor 1.

When the shift rod 48 is rotated by rotating the shift grip 43, the shift pin 54 whose moving direction is restricted by the slit 53 in the steering arm housing 42 moves linearly in the back and forth direction along the helical groove 52, so that the shift cable 55 connected to the shift pin 54 executes the push-pull movement to thereby transmit a shifting operation of the operator.

A projecting portion 43*a* is formed on the shift grip 43 to be directed perpendicularly when the shift unit is in a neutral position. Then, the operator can easily recognize the states of the shift unit (i.e., forward/neutral/reverse state) by recognizing the position of this projecting portion 43*a* by seeing or by touching. Although not shown in detail, this projecting portion 43*a* may be applied to the shift grip 17 of the steering arm unit 10 of the first embodiment.

In the steering arm unit 40 shown in the second embodiment, by indicating F (forward), N (neutral) and R (reverse) on the side portion of the slit 53 of the steering arm housing 42 as shown in FIG. 6, the status of the shift unit can be confirmed with the position of the shift pin 54.

A cutout 56F and a cutout 56R, which allow the throttle to be rotated up to a full opening position when the shift pin 54 is located at the forward and reverse positions, are formed in a portion covering the shift drum 51 of the cylindrical throttle rod 49 covering the shift rod 48. On the other hand, a cutout 56N, which allows the throttle to be rotated up to a predetermined opening degree when the shift pin 54 is located at a neutral position, is formed. Thus, a throttle operating degree restricting mechanism is constituted of the cutouts 56F, 56R and 56N.

The structures of the throttle adjusting knob 45 and the steering adjusting knob 46 are the same as those of the first embodiment, and description thereof will not be repeated here.

Next, the operation of this embodiment will be described.

A shift operating unit (i.e., shift grip 17), a throttle operating unit (i.e., throttle grip 18), a throttle adjusting operating unit (i.e., throttle adjusting knob 19), and a steering adjusting operating unit (i.e., steering adjusting knob 20) are adjacently disposed along a forward direction at the front end portion of the steering arm housing 11 so as to constitute the steering arm 9. Accordingly, the respective operating units 17 to 20 can be disposed in compact, thereby improving the operability. Particularly, the steering adjusting operating unit (i.e., steering adjusting knob 20) conventionally disposed on the outboard motor 1 main body is disposed on the steering arm 9 in the described embodiment, thus extremely improving the operability.

Furthermore, by adopting the rotation operating system to the respective operating units 17 to 20 and disposing them on the same rotating shaft 21, the projecting portion is eliminated and a compact configuration can be provided. In addition, since the rotating axis 29 of the throttle adjusting operating unit (i.e., throttle adjusting knob 19) and the rotating axis 21 of the throttle operating unit (i.e., throttle grip 18) are disposed with the offset 30, the components or parts can be reduced in numbers and a compact configuration can be achieved, thereby realizing a large contact surface with a simple structure and improving the adjustability of the steering arm.

It is to be noted that the present invention is not limited to the described embodiments and many other changes and modifications may be made without departing from the scopes of the appended claims.

What is claimed is:

1. A steering arm structure of an outboard motor steerably mounted to a hull via a bracket, in which a steering arm is mounted to a steering bracket unit attached to the outboard motor, the steering arm comprising:

a shift operating unit;

a throttle operating unit; and a throttle adjusting operating unit which are adjacently disposed in the described order along an advancing direction of the hull, wherein the shift operating unit, the throttle operating unit and the throttle adjusting operating unit are disposed coaxially on a common rotation axis.

2. The steering arm structure of the outboard motor according to claim 1, wherein the steering arm further includes a steering adjusting operating unit disposed adjacently to the throttle adjusting operating unit.

3. The steering arm structure of the outboard motor according to claim 2, wherein the steering adjusting operating unit is disposed coaxially on a common rotation axis of the throttle adjusting operating unit.

4. The steering arm structure of the outboard motor according to claim 1, wherein the throttle adjusting operating unit has a rotation axis that is offset from a rotation axis of the throttle operating unit.

5. A steering arm structure of an outboard motor steerably mounted to a hull via a bracket, in which a steering arm is mounted to a steering bracket unit attached to the outboard motor, the steering arm comprising:

a shift operating unit;

a throttle operating unit; and a throttle adjusting operating unit which are adjacently disposed in the described order along an advancing direction of the hull, wherein the shift operating unit includes a shift grip, the throttle operating unit includes a throttle grip, and the throttle adjusting operating unit includes a throttle adjusting knob, the shift grip, the throttle grip and the throttle adjust knob being arranged to be rotatable, and the steering arm further includes a steering adjusting operating unit including a steering adjusting knob rotatably disposed adjacent to the throttle adjusting knob.

* * * * *